US007561043B2

(12) United States Patent
Hasegawa et al.

(10) Patent No.: US 7,561,043 B2
(45) Date of Patent: Jul. 14, 2009

(54) MARKER FOR MECHANICALLY RESONANT ARTICLE SURVEILLANCE SYSTEM

(75) Inventors: Ryusuke Hasegawa, Morristown, NJ (US); John Paul Webb, Myrtle Beach, SC (US); Auburn Anthony Chestnut, Conway, SC (US); Larry Hill, Myrtle Beach, SC (US); Ronald Joseph Martis, East Hanover, NJ (US)

(73) Assignee: Metglas, Inc., Conway, SC (US)

( * ) Notice: Subject to any disclaimer, the term of this patent is extended or adjusted under 35 U.S.C. 154(b) by 289 days.

(21) Appl. No.: 11/607,997

(22) Filed: Dec. 4, 2006

(65) Prior Publication Data

US 2007/0080808 A1 Apr. 12, 2007

Related U.S. Application Data

(63) Continuation-in-part of application No. 11/095,611, filed on Apr. 1, 2005, now Pat. No. 7,205,893.

(51) Int. Cl.
*G08B 13/14* (2006.01)

(52) U.S. Cl. ..... 340/568.1; 340/572.6

(58) Field of Classification Search ..... 340/572.6, 340/568.1

See application file for complete search history.

(56) References Cited

U.S. PATENT DOCUMENTS

| | | | | |
|---|---|---|---|---|
| 4,142,571 | A | 3/1979 | Narasimhan | |
| 4,510,489 | A | 4/1985 | Anderson, III et al. | |
| 4,510,490 | A | 4/1985 | Anderson, III et al. | |
| 4,647,917 | A * | 3/1987 | Anderson et al. | 340/572.4 |
| 4,658,263 | A * | 4/1987 | Urbanski | 343/788 |
| 5,495,231 | A | 2/1996 | Hasegawa | |
| 5,539,380 | A | 7/1996 | Hasegawa et al. | |
| 5,628,840 | A | 5/1997 | Hasegawa | |
| 5,650,023 | A | 7/1997 | Hasegawa et al. | |
| 5,969,612 | A | 10/1999 | Gadonniex et al. | |
| 6,067,015 | A * | 5/2000 | Lian et al. | 340/572.1 |
| 6,093,261 | A | 7/2000 | Hasegawa et al. | |
| 6,187,112 | B1 | 2/2001 | Hasegawa et al. | |
| 6,299,702 | B1 | 10/2001 | Herzer | |
| 6,359,563 | B1 | 3/2002 | Herzer | |
| 6,471,789 | B1 * | 10/2002 | Ames et al. | 148/304 |
| 6,551,416 | B1 * | 4/2003 | Herzer | 148/108 |
| 7,005,989 | B2 * | 2/2006 | Benoit et al. | 340/572.5 |
| 7,026,938 | B2 | 4/2006 | Herzer | |
| 7,065,440 | B2 | 6/2006 | Aral | |

(Continued)

OTHER PUBLICATIONS

Ito, Shigeyasu et al., "Magnetostriction and magnetization of iron-based amorphous alloys", Applied Physics. Letter, vol. 37, No. 7, pp. 665-666, (Oct. 1980).

(Continued)

*Primary Examiner*—Eric M Blount

(57) ABSTRACT

A magnetomechanical resonance element or marker strip with facilitated performance based on an amorphous magnetostrictive alloy ribbon is utilized in an electronic article surveillance marker. A curvature along the element's length direction is introduced during ribbon fabrication with a different radius of curvature, which increases the resonance performance with minimal loss in the magneto-mechanical circuit, and more particularly, in a marker utilizing a plurality of resonating elements or marker strips. A marker is fabricated utilizing the resonance element or elements and is utilized in an electronic article surveillance system.

21 Claims, 13 Drawing Sheets

U.S. PATENT DOCUMENTS

| | | | | |
|---|---|---|---|---|
| 7,075,440 | B2 * | 7/2006 | Fabian et al. | 340/572.6 |
| 2002/0140558 | A1 * | 10/2002 | Lian et al. | 340/572.8 |

OTHER PUBLICATIONS

Chikazumi, Soshin, "Physics of Magnetism", pp. 431-437 (1964).
J.D. Livingston, "Magnetomechanical Properties of Amorphous Metals", phys. stat. Sol. (a) 70, 591 (1982), pp. 591-596.
U.S. Appl. No. 11/095,559, filed Dec. 4, 2006, Hasegawa, Metglas, Inc.
U.S. Appl. No. 11/095,611, filed Apr. 1, 2005, Hasegawa, et al., Metglas, Inc.
U.S. Appl. No. 11/095,559, filed Apr. 1, 2005, Hasegawa, Metglas, Inc.
PCT Notification of transmittal of the international search report and the written opinion of the international searching authority, or the declaration, Form PCT/ISA/220, 2 pages dated Sep. 7, 2006.
PCT International Search Report, Form PCT/ISA/210, 2 pages, dated Sep. 7, 2006.
PCT Written opinion of the international Searching Authority, Form PCT/ISA/237, 7 pages, dated Sep. 7, 2006.
PCT Notification Concerning Transmittal of International Preliminary Report on Patentability dated Sep. 9, 2008 (1 pg.).
PCT International Preliminary Report on Patentability dated Aug. 1, 2008 (20 pgs.).
PCT Notification Concerning Transmittal of Copy of International Preliminary Report on Patentability dated Oct. 11, 2007 (in English).
PCT International Preliminary Report on Patentability dated Oct. 3, 2007 (in English).

* cited by examiner

MARKER FOR MECHANICALLY RESONANT ARTICLE SURVEILLANCE SYSTEM

CROSS-REFERENCE TO RELATED APPLICATION

This application is a continuation-in-part of U.S. Ser. No. 11/095,611, filed Apr. 1, 2005 now U.S. Pat. No. 7,205,893, the disclosure of which is incorporated herein by reference.

BACKGROUND OF THE INVENTION

1. Field of the Invention

The present invention relates to ferromagnetic amorphous alloy ribbon and to a marker for use in an electronic article surveillance system, the marker consisting of one or a plurality of rectangular strips based on an amorphous magnetostrictive material that vibrates in an alternating magnetic field mechanically at a resonant frequency varying with an applied static magnetic field, whereby the magnetomechanical effect of the marker is effectively utilized. The present invention is also directed to an electronic article surveillance system utilizing such a marker.

2. Background of the Invention

Magnetostriction of a magnetic material is a phenomenon in which a dimensional change takes place upon application of an external magnetic field on the magnetic material. When the dimensional change is such that the material elongates upon its being magnetized, the material is termed "positive-magnetostrictive". When a material is "negative-magnetostrictive", the material shrinks upon its magnetization. Thus in either case, a magnetic material vibrates when it is in an alternating magnetic field. When a static magnetic field is applied along with the alternating field, the frequency of the mechanical vibration of the magnetic material varies with the applied static field through magneto-elastic coupling. This is commonly known as ΔE effect, which is described, for example, in "Physics of Magnetism" by S. Chikazumi (John Wiley & Sons, New York, 1964, page 435). Here E(H) stands for Young's modulus, which is a function of applied magnetic field H, and the material's vibrational or resonance frequency $f_r$ is related to E(H) through $$f_r=(1/2l)[E(H)/\rho]^{1/2}, \quad (1)$$

where l is the length of the material and ρ is the mass density of the material.

The magneto-elastic or magneto-mechanical effect described above is utilized in electronic article surveillance systems which were first taught in the U.S. Pat. Nos. 4,510,489 and 4,510,490 (hereinafter the '489 and '490 patents). Such surveillance systems are advantageous systems, in that they offer a combination of high detection sensitivity, high operating reliability and low operating costs.

A marker in such systems is a strip, or a plurality of strips, of known length of a ferromagnetic material, packaged with a magnetically harder ferromagnet (material with a higher coercivity) that provides a static field termed as bias field to establish peak magneto-mechanical coupling. In accordance with embodiments of the invention, ferromagnetic marker material is an amorphous alloy ribbon, since the efficiency of magneto-mechanical coupling in the alloys is very high. The mechanical resonance frequency, $f_r$ is determined essentially by the length of the alloy ribbon and the bias field strength, as Equation (1) above indicates.

When an interrogating signal tuned to the resonance frequency is encountered in a surveillance system, the marker material responds with a large signal field which is detected by a receiver in the system.

Several amorphous ferromagnetic materials were considered for electronic article surveillance systems based on magnetomechanical resonance described above in the original '489 and '490 patents and included amorphous Fe—Ni—Mo—B, Fe—Co—B—Si, Fe—B—Si—C and Fe—B—Si alloys. Of the alloys, a commercially available amorphous Fe—Ni—Mo—B based METGLAS®2826MB alloy was used extensively until accidental triggering, by a magnetomechanical resonance marker, of other systems based on magnetic harmonic generation/detection. This occurs because a magnetomechanical resonance marker used at that time sometimes exhibited non-linear BH characteristics, resulting in generation of higher harmonics of the exciting field frequency. To avoid this problem, sometimes called a system "pollution problem," a series of new marker materials were invented, examples of which were disclosed in U.S. Pat. Nos. 5,495,231, 5,539,380, 5,628,840, 5,650,023, 6,093,261 and 6,187,112. Although the new marker materials perform, on average, better than the materials utilized in the surveillance systems of the original '489 and '490 patents, somewhat better magnetomechanical performance was found in the marker materials disclosed, for example, in U.S. Pat. No. 6,299,702 (hereinafter, the '702 patent). The new marker materials require complicated heat-treatment processes to achieve desired magnetomechanical properties as disclosed, for example, in the '702 patent. Clearly, a new magnetomechanical marker material is needed which does not require such complicated post-ribbon fabrication processes, and the present invention provides such a marker material with high magnetomechanical performance without causing the "pollution problem" that is mentioned above. A marker strip in accordance with the '702 patent is widely used for a marker with two strips, as is disclosed in U.S. Pat. No. 6,359,563. Due to the fact that the two strips have the same radius of curvature along the strip width direction since each of them was processed in exactly the same way, in accordance with the '702 patent, the two strips touch each other at many points on the strip surfaces, damping the magnetomechanical vibration on the strips, and hence reducing the effectiveness of the marker. This drawback needs to be ameliorated. Furthermore, there is a need for an effective electronic article surveillance system which utilizes such a marker.

SUMMARY OF THE INVENTION

In accordance with an embodiment of the invention, a soft magnetic material is utilized for a marker of an electronic article surveillance system based on magnetomechanical resonance.

A marker material with enhanced overall magnetomechanical resonance properties is fabricated from an amorphous alloy ribbon. The magnetic marker material in a ribbon form having magnetomechanical resonance capability is cast on a rotating substrate as taught in the U.S. Pat. No. 4,142,571. When the as-cast ribbon width is wider than the predetermined width for a marker material, said ribbon is slit to said predetermined width. The ribbon thus prepared is cut into ductile, rectangular amorphous metal marker strips having a predetermined length to fabricate a magnetomechanical resonance marker using one or a plurality of said marker strips with at least one semi-hard magnet strip which provides a bias static magnetic field. Said magnetomechanical resonance marker does not trigger other systems based on the principle of magnetic higher harmonics generation/detection.

An electronic article surveillance system utilizes a marker of the present invention. The system has an article interrogation zone in which a magnetomechanical marker of the present invention is subject to an interrogating magnetic field at the resonance frequency of a marker strip, the signal response to the interrogating magnetic field excitation being detected by a receiver having a pair of antenna coils situated in the article interrogation zone. The received magnetomechanical resonance signal is then processed by a signal detection circuit which identifies the marker.

In accordance with an embodiment of the invention, a marker of a magnetomechanical resonant electronic article surveillance system, comprises: at least one ductile magnetostrictive strip cut from an amorphous ferromagnetic alloy ribbon that has a curvature along a ribbon length direction and exhibits magnetomechanical resonance under alternating magnetic field excitation with a static bias field, the at least one marker strip having a magnetic anisotropy direction along a direction perpendicular to a ribbon axis.

Where selected, a radius of curvature of the at least one ductile magnetostrictive marker strip is less than 120 cm.

In accordance with an embodiment of the invention, the amorphous ferromagnetic alloy ribbon has a saturation induction ranging from 0.6 tesla to 1.1 tesla.

In accordance with an embodiment of the invention, the amorphous ferromagnetic alloy ribbon has a saturation magnetostriction ranging from 6 ppm to 18 ppm.

In accordance with an embodiment of the invention, the amorphous ferromagnetic alloy ribbon has a composition based on $Fe_a$—$Ni_b$—$Mo_c$—$B_d$ with $30 \leqq a \leqq 43$, $35 \leqq b \leqq 48$, $0 \leqq c \leqq 5$, $14 \leqq d \leqq 20$ and $a+b+c+d=100$, up to 3 atom % of Mo being optionally replaced by Co, Cr, Mn and/or Nb and up to 1.5 atom % of B being optionally replaced by Si and/or C.

In accordance with an embodiment of the invention, the amorphous ferromagnetic alloy ribbon is an alloy having a composition of one of $Fe_{41.7}Ni_{39.4}Mo_{3.1}B_{15.8}$, $Fe_{41.5}Ni_{38.9}Mo_{4.1}B_{15.5}$, $Fe_{39.8}Ni_{39.2}Mo_{3.1}B_{17.6}C_{0.3}$, $Fe_{40.2}Ni_{39.0}Mo_{3.6}B_{16.6}Si_{0.6}$, $Fe_{36.5}Ni_{42.9}Mo_{42.2}B_{16.5}$, $Fe_{40.6}Ni_{40.1}Mo_{3.7}B_{15.1}Si_{0.5}$, $Fe_{39.6}Ni_{38.3}Mo_{4.1}B_{18.0}$, $Fe_{38.0}Ni_{38.8}Mo_{3.9}B_{19.3}$, $Fe_{36.9}Ni_{41.3}Mo_{4.1}B_{17.8}$, $Fe_{36.7}Ni_{41.9}Mo_{4.0}B_{16.6}Si_{0.8}$, $Fe_{35.6}Ni_{42.6}Mo_{4.0}B_{17.9}$, $Fe_{34.7}Ni_{43.5}Mo_{4.0}B_{17.8}$, $Fe_{33.3}Ni_{43.8}Mo_{3.9}Co_{0.2}Cr_{0.1}B_{17.7}Si_{1.0}$, or $Fe_{32.5}Ni_{44.7}Mo_{3.7}Co_{0.1}Cr_{0.2}B_{18.0}Si_{0.8}$.

In accordance with an embodiment of the invention, the at least one marker strip has a discrete length and exhibits magnetomechanical resonance at a length-related frequency.

Where selected, the at least one marker strip has a length ranging from about 15 to about 65 mm.

Where selected, the at least one marker strip has a marker strip width ranging from about 3 mm to about 15 mm.

In accordance with an embodiment of the invention, the at least one marker strip has a length-to-width ratio exceeding 3.

In accordance with an embodiment of the invention, the at least one marker strip has a characteristic time constant for magnetomechanical resonance signal decay ranging from about 0.7 msec to about 3.9 msec.

In accordance with an embodiment of the invention, the at least one marker strip has a characteristic BH loop with a near-zero remanent magnetic induction at zero-applied magnetic field.

In accordance with an embodiment of the invention, the at least one marker strip has a slope of resonance frequency versus bias field ranging from about 4 Hz/(A/m) to about 14 Hz/(A/m).

In accordance with an embodiment of the invention, the marker comprises a plurality of marker strips with different radius of curvatures along the marker strips' length direction.

Where selected, the plurality of marker strips are stacked or placed side-by-side.

In accordance with an embodiment of the invention, the marker comprises two marker strips and has a slope of resonance frequency versus bias field ranging from about 3.5 Hz/(A/m) to about 10 Hz/(A/m).

In accordance with an embodiment of the invention, the marker comprises three marker strips and has a slope of resonance frequency versus bias field ranging from about 4 Hz/(A/m) to about 9 Hz/(A/m).

In accordance with an embodiment of the invention, the marker comprises four or five marker strips and has a slope of resonance frequency versus bias field ranging from about 2 Hz/(A/m) to about 4 Hz/(A/m).

Where selected, at least one bias magnet strip is placed along the at least one marker strip's direction.

In accordance with an embodiment of the invention, the at least one marker strip is housed in a cavity separated from the bias magnet strip.

In accordance with an embodiment of the invention, electronic article surveillance system has a capability of detecting resonance of a marker, and comprises a surveillance system tuned to predetermined surveillance magnetic field frequencies, wherein the surveillance system detects a marker that is adapted to mechanically resonate at a preselected frequency, and has at least one ductile magnetostrictive marker strip cut from an amorphous ferromagnetic alloy ribbon that has a curvature along a ribbon length direction and exhibits magnetomechanical resonance under alternating magnetic field excitation with a static bias field, the at least one marker strip having a magnetic anisotropy direction along a direction perpendicular to a ribbon axis.

Where selected, a radius of curvature of the at least one ductile magnetostrictive marker strip is between about 20 cm and about 100 cm in accordance with embodiments of the invention.

BRIEF DESCRIPTION OF THE DRAWINGS

The invention will be more fully understood and further advantages will become apparent when reference is made to the following detailed description of the embodiments and the accompanying drawings in which:

FIGS. 8A-1 and 8A-2 illustrate a comparison of a physical profile of an embodiment of a magnetomechanical resonant marker of the present invention with two marker-strips whose side view is shown in element 122, and FIGS. 8B-1 and 8B-2 illustrate a comparison of a conventional marker with two conventional art strips whose angled view is shown in element 222;

DETAILED DESCRIPTION OF THE EMBODIMENTS

A marker material with enhanced overall magnetomechanical resonance properties is fabricated from an amorphous alloy ribbon. The magnetic marker material in a ribbon form having magnetomechanical resonance capability is cast on a rotating substrate as taught in the U.S. Pat. No. 4,142,571. When the as-cast ribbon width is wider than the predetermined width for a marker material, the ribbon is slit to the predetermined width. The ribbon thus prepared is cut into ductile, rectangular amorphous metal strips having a predetermined length to fabricate a magnetomechanical resonance marker using one or a plurality of the strips with at least one semi-hard magnet strip which provides a bias static magnetic field. The magnetomechanical resonance marker does not trigger other systems based on the principle of magnetic higher harmonics generation/detection.

In one embodiment of the present invention, the amorphous ferromagnetic alloy utilized to form a ribbon for the marker strip has a composition based on $Fe_a$—$Ni_b$—$Mo_c$—$B_d$ with $30 \leqq a \leqq 43$, $35 \leqq b \leqq 48$, $0 \leqq c \leqq 5$, $14 \leqq d \leqq 20$ and a+b+c+d=100, up to 3 atom % of Mo being optionally replaced by Co, Cr, Mn and/or Nb and up to 1.5 atom % of B being optionally replaced by Si and/or C.

Figure 1A:
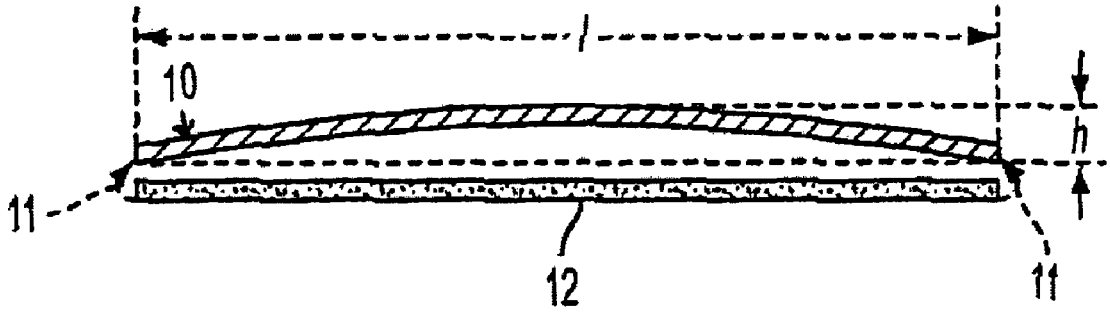
FIG. 1A illustrates a side view of a marker strip cut from an amorphous alloy ribbon in accordance with an embodiment of the present invention and having a bias magnet.
Figure 1B:
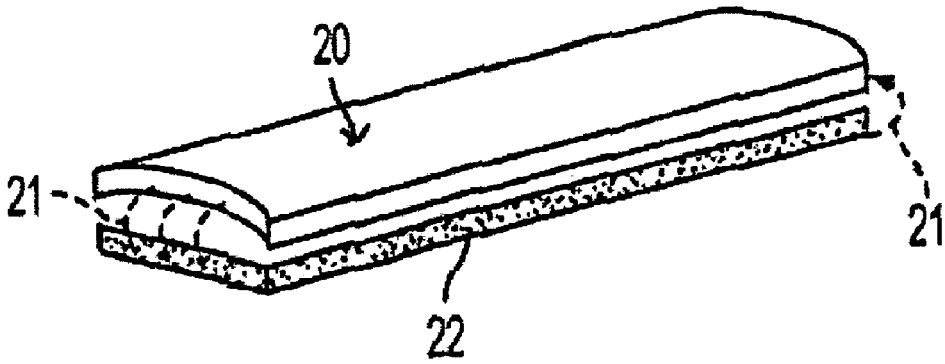
FIG. 1B CONVENTIONAL ART
FIG. 1B illustrates a view of a conventional marker strip with a bias magnet.

In certain embodiments of the present invention, the amorphous ferromagnetic alloy utilized to form a ribbon for the marker strip has a composition of one of $Fe_{41.7}Ni_{39.4}Mo_{3.1}B_{15.8}$, $Fe_{41.5}Ni_{38.9}Mo_{4.1}B_{15.5}$, $Fe_{39.8}Ni_{39.2}Mo_{3.1}B_{17.6}C_{0.3}$, $Fe_{40.2}Ni_{39.0}Mo_{3.6}B_{16.6}Si_{0.6}$, $Fe_{36.5}Ni_{42.9}Mo_{4.2}B_{16.5}$, $Fe_{40.6}Ni_{40.1}Mo_{3.7}B_{15.1}Si_{0.5}$, $Fe_{39.6}Ni_{38.3}Mo_{4.1}B_{18.0}$, $Fe_{38.0}Ni_{38.8}Mo_{3.9}B_{19.3}$, $Fe_{36.9}Ni_{41.3}Mo_{4.1}B_{17.8}$, $Fe_{36.7}Ni_{41.9}Mo_{4.0}B_{16.6}Si_{0.8}$, $Fe_{35.6}Ni_{42.6}Mo_{4.0}B_{17.9}$, $Fe_{34.7}Ni_{43.5}Mo_{4.0}B_{17.8}$, $Fe_{33.3}Ni_{43.8}Mo_{3.9}Co_{0.2}Cr_{0.1}B_{17.7}Si_{1.0}$, or $Fe_{32.5}Ni_{44.7}Mo_{3.7}Co_{0.1}Cr_{0.2}B_{18.0}Si_{0.8}$ Thus, an amorphous magnetostrictive alloy having a chemical composition similar to a chemical composition of a commercially available amorphous METGLAS®2826MB ribbon was cast in accordance with the invention described in the U.S. Pat. No. 4,142,571. The amorphous alloy had a saturation induction ranging from 0.6 Tesla to 1.1 Tesla and a saturation magnetostriction ranging from 6 ppm to 18 ppm. The cast ribbon had widths of about 100 mm and about 25 mm, and its thickness was about 28 μm. The ribbon was then slit into narrower ribbons with different widths. The slit ribbon then was cut into ductile, rectangular strips having a length ranging from about 15 mm to about 65 mm. Each strip had a slight curvature reflecting ribbon casting wheel surface curvature. During slitting, the original curvature was modified. The curvature of a slit and cut strip was determined as described in Example 1. FIG. 1A illustrates the physical appearance of a marker strip 10 of an embodiment of the present invention having a bias magnet 12, and FIG. 1B illustrates the physical appearance of a conventional strip 20 produced in accordance with a complex heat-treatment method disclosed in the U.S. Pat. No. 6,299,702. As indicated in FIG. 1A, magnetic flux lines 11 are more closed in a resonance marker-bias strip configuration of an embodiment of the present invention than the magnetic flux lines 21 of a conventional strip as is illustrated in FIG. 1B. This enables better coupling between a marker strip 10 of an embodiment of the present invention and a bias magnet strip 12 than is achieved by a conventional strip 20 and a bias magnet 22, which results in less flux leakage at the two ends of a resonance marker strip of the embodiment of the present invention. The shape of a curved marker strip of an embodiment of the present invention as exemplified in FIG. 1A enables the strip to vibrate freely without any physical constraints. This aspect is very important in electronic article surveillance systems as any physical constraint of a marker strip dampens its mechanical vibration. If a rigid support is introduced at any portion of a marker strip, for example, when the center of a marker strip, whether it is curved or not, is attached to some other material, such as the bias magnet 12 in FIG. 1A or marker tag case 30 in FIG. 7A, the resonance frequency of the marker strip nearly doubles according to Eq. (1), and the resonance signal level which is proportional to the strip's physical volume is reduced considerably. This is detrimental for effective operation of an electronic article surveillance system. Each resonance marker strip of the embodiment of the present invention and the conventional strip was examined in light of magnetomechanical resonance performance using a characterization method of Example 2.

Figure 2:
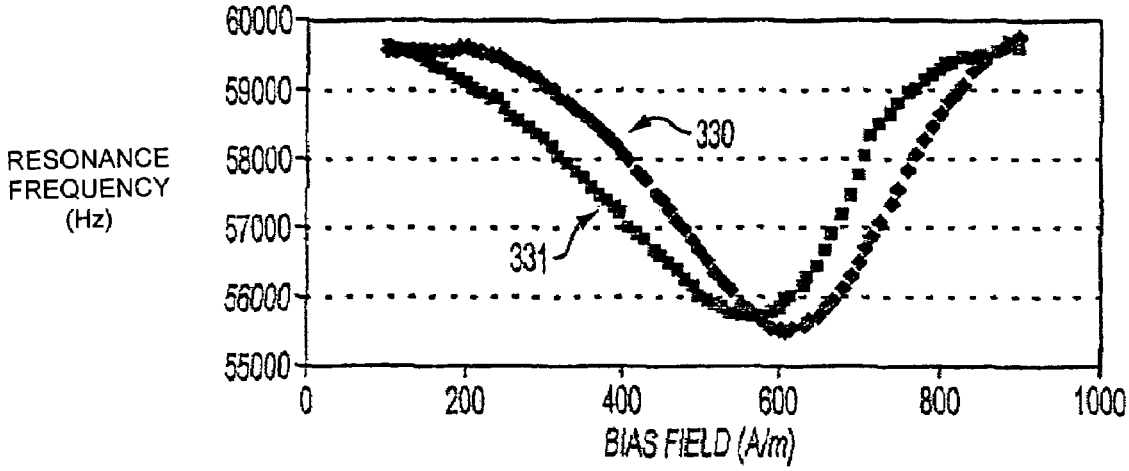
FIG. 2 illustrates magnetomechanical resonance characteristics of a single strip marker of the present invention and magnetomechanical resonance characteristics of a conventional single strip marker, showing resonance frequency as a function of bias field.

FIG. 2 compares the resonance frequency as a function of bias field for a single strip marker 330 of an embodiment of the present invention and the resonance frequency of a conventional strip 331, both of which had a width of about 6 mm and a length of about 38 mm. FIG. 2 indicates that the resonance frequency change as a function of bias field is about the same for both cases. The resonance characteristics depicted in FIG. 2 are important in designing a resonance marker with deactivation capability because deactivation is accomplished by a change in the resonance frequency by changing bias field strength. During deactivation, the slope of the resonance frequency $f_r$ with respect to bias field $H_b$, i.e., $df_r/dH_b$, determines the effectiveness of deactivation, and therefore is an important factor for an effective resonance marker strip.

Figure 3:
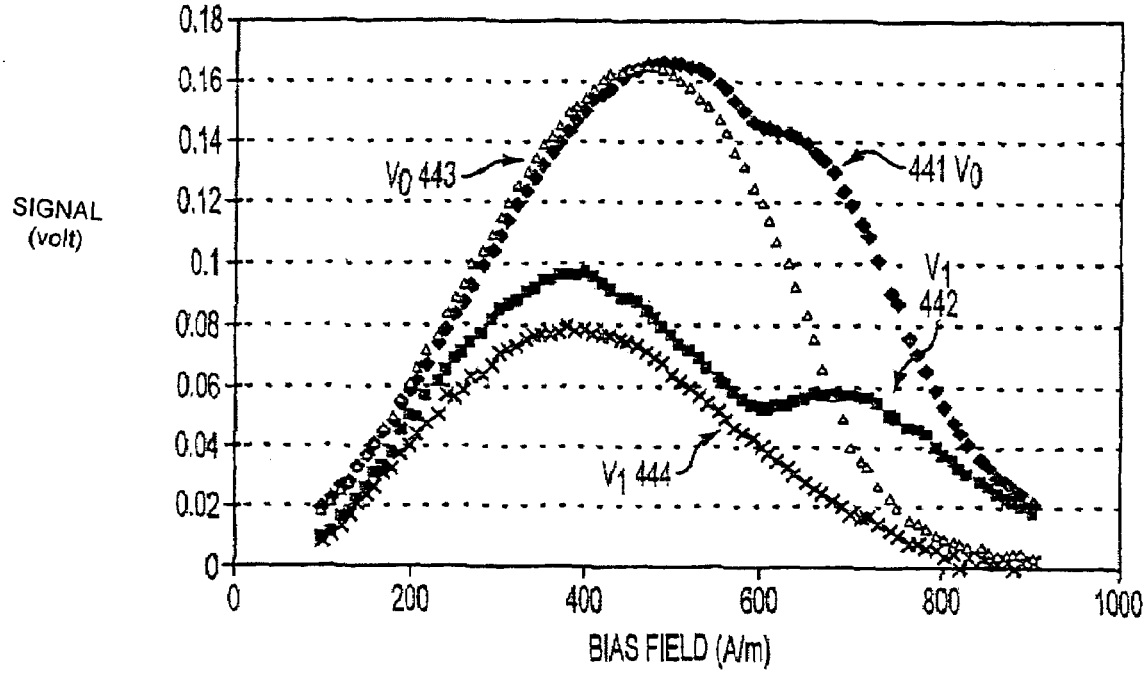
FIG. 3 illustrates resonance signals of a single strip marker in accordance with an embodiment of the present invention and resonance signals of a conventional strip marker, showing resonance signal amplitudes as a function of bias field.

Comparison of the resonance response between the two cases is illustrated in FIG. 3, in which $V_0$ is the response signal amplitude when the exciting field is turned off, and $V_1$ is the signal amplitude at 1 msec after the termination of the exciting field. Clearly, a higher $V_1/V_0$ ratio is selected for a better performance of a resonance marker. Both of the signal amplitudes are therefore used in industry as part of the figure of merit for a magnetomechanical resonance marker. FIG. 3 indicates that the signal amplitude $V_0$ 441 and $V_1$ 442 become maximum at a bias field of $H_{b0}$=500 A/m and $H_{b1}$=400 A/m, respectively, for a resonance marker strip of an embodiment of the present invention, and $V_0$ 443 and $V_1$ 444 become maximum at bias fields of $H_{b0}$=460 A/m and $H_{b1}$=400 A/m, respectively, for a conventional resonance marker strip. In addition, FIG. 3 indicates that the ratio of $V_1/V_0$ at these maximum points is higher for a resonance marker strip of an embodiment of the present invention than for a conventional marker strip, illustrating that signal retention in a marker strip of an embodiment of the present invention is better than in a conventional marker.

Table I summarizes a comparison of parameters critical for the performance of a marker strip as a magnetomechanically resonating element between representative conventional marker strips and examples from the marker strips of an embodiment of the present invention. It is noted that the performance of the marker strips of the embodiment of the present invention is close to, or superior to, the performance of conventional marker strips. As far as the performance of a marker strip is concerned, the signal voltage, $V_1$, is a critical factor that determines the marker performance in an electronic article surveillance system. In view of this, all of the marker strips of embodiment of the present invention in Table I are acceptable for use in markers of the embodiment of the present invention with each of the strip's height h, as defined in FIG. 1A, between 0.15 mm and 0.64 mm, which corresponds to the strip's length direction radius of curvature between 28 cm and 119 cm as given in Table I.

In Table I, maximum signal voltage for $V_0$ and $V_1$ measured at bias field strength, $H_{b0}$ and $H_{b1}$, respectively, and the resonance frequency slope, $df_r/dH_b$, measured at $H_{b1}$ for marker strips of the embodiment of the present invention with strip curvature h, as defined in FIG. 1A, were compared with corresponding characteristics for ten conventional marker strips, randomly selected.

The length, l of the strips were all about 38 mm, and their widths were about 6 mm. A radius of curvature for each marker strip was calculated from h and l. The resonance frequency of each strip was about 58 kHz.

TABLE I

Magnetomechanical Resonance Characteristics

| Marker | $V_{0max}$ (mV) | $H_{b0}$ (A/m) | $V_{1max}$ (mV) | $H_{b1}$ (A/m) | $df_r/dH_b$ [Hz/(A/m)] | h (mm) | Radius of Curvature (cm) |
|---|---|---|---|---|---|---|---|
| Conventional | 140~180 | 440~500 | 60~102 | 360~420 | 5.60~11.5 | — | — |
| Present Invention No. 1 | 108 | 432 | 76 | 350 | 4.79 | 0.15 | 119 |
| No. 2 | 167 | 490 | 97 | 400 | 12.0 | 0.18 | 100 |
| No. 2 | 156 | 470 | 86 | 410 | 9.50 | 0.18 | 100 |
| No. 4 | 159 | 490 | 84 | 410 | 12.5 | 0.20 | 90 |
| No. 5 | 167 | 490 | 94 | 400 | 11.8 | 0.20 | 90 |
| No. 6 | 183 | 458 | 110 | 390 | 11.8 | 0.23 | 78 |
| No. 7 | 165 | 488 | 94 | 370 | 12.5 | 0.23 | 78 |
| No. 8 | 178 | 471 | 106 | 391 | 12.3 | 0.28 | 65 |
| No. 9 | 160 | 460 | 92 | 379 | 10.8 | 0.28 | 65 |
| No. 10 | 157 | 461 | 87 | 351 | 9.10 | 0.36 | 50 |
| No. 11 | 147 | 420 | 76 | 391 | 10.3 | 0.64 | 28 |

Table I contains data for a marker strip width of about 6 mm, which is presently widely used. It is one aspect of the present invention to provide marker strips with widths different than about 6 mm. Marker strips with different widths were slit from the same ribbon used in Table I, and their magnetomechanical resonance characteristics were determined. The results are summarized in Table II. The resonance signal voltages, $V_{0\,max}$ and $V_{1max}$ decreased with decreasing width, as expected. The decrease in the characteristic field values, $H_{b0}$ and $H_{b1}$, with decreasing width is due to demagnetizing effects. Thus, a bias field magnet must be selected accordingly. A marker with a smaller width is suited for a smaller article surveillance area, whereas a marker with a larger width is suited for a larger article surveillance area because resonance signals are larger from larger marker strips, as Table II indicates. Since the resonance frequency depends primarily on the strip length, as Equation (1) indicates, the strip width change does not affect the resonance frequency of the article surveillance system used.

Table II shows the magnetomechanical resonance characteristics of marker strips of an embodiment of the present invention with strip height h, as defined in FIG. 1A, and with different strip widths. The definitions for $V_{0\,max}$, $H_{b0}$, $V_{1\,max}$, $H_{b1}$, and $df_r/dH_b$ were the same as in Table I. The length l of the strips were all about 38 mm. A radius of curvature for each marker strip was calculated from h and l. The resonance frequency of each strip was about 58 kHz.

TABLE II

Magnetomechanical Resonance Characteristics

| Marker Width (mm) | $V_{0max}$ (mV) | $H_{b0}$ (A/m) | $V_{1max}$ (mV) | $H_{b1}$ (A/m) | $df_r/dH_b$ [Hz/(A/m)] | h (mm) | Radius of Curvature (cm) |
|---|---|---|---|---|---|---|---|
| 4 | 107 | 310 | 56 | 330 | 4.69 | 0.61 | 30 |
| 5 | 153 | 300 | 76 | 300 | 6.05 | 0.41 | 44 |
| 9 | 194 | 500 | 101 | 440 | 4.84 | 0.81 | 22 |
| 14 | 321 | 590 | 174 | 511 | 4.86 | 0.84 | 21 |

Another aspect of the present invention is to provide a variety of available markers operated under different conditions. For this purpose, magnetomechanical resonance characteristics were varied by changing the chemical composition of the amorphous magnetic alloy ribbon from which marker strips were produced. The chemical compositions of the alloys examined are listed in Table III, in which values of the saturation induction and magnetostrictions for the alloys are given. The results of the magnetomechanical resonance properties of these alloys are given in Table IV below.

Table III shows examples of magnetostrictive amorphous alloys with their compositions, saturation inductions, $B_s$, and saturation magnetostrictions, $\lambda_s$, for magnetomechanical resonance markers of an embodiment of the present invention. The values of $B_s$ were determined from DC BH loop measurements of Example 3, and the values of $\lambda_s$ were calculated by using an empirical formula $\lambda_s = k B_s^2$, with k=15.5 ppm/tesla$^2$, following S. Ito et al., *Applied Physics Letters*, vol. 37, p. 665 (1980).

TABLE III

Magnetostrictive Amorphous Alloy

| Alloy No. | Marker Chemical Composition (numbers in atom %) | Saturation Induction $B_s$ (tesla) | Saturation Magneto-striction $\lambda_s$ (ppm) |
|---|---|---|---|
| A | $Fe_{41.7}Ni_{39.4}Mo_{3.1}B_{15.8}$ | 1.03 | 16 |
| B | $Fe_{41.5}Ni_{38.9}Mo_{4.1}B_{15.5}$ | 0.98 | 15 |
| C | $Fe_{39.8}Ni_{39.2}Mo_{3.1}B_{17.6}C_{0.3}$ | 0.94 | 14 |
| D | $Fe_{40.2}Ni_{39.0}Mo_{3.6}B_{16.6}Si_{0.6}$ | 0.93 | 13.5 |
| E | $Fe_{36.5}Ni_{42.9}Mo_{4.2}B_{16.5}$ | 0.90 | 12.6 |
| F | $Fe_{40.6}Ni_{40.1}Mo_{3.7}B_{15.1}Si_{0.5}$ | 0.88 | 12 |
| G | $Fe_{39.6}Ni_{38.3}Mo_{4.1}B_{18.0}$ | 0.88 | 12 |
| H | $Fe_{38.0}Ni_{38.8}Mo_{3.9}B_{19.3}$ | 0.84 | 11 |
| I | $Fe_{36.9}Ni_{41.3}Mo_{4.1}B_{17.8}$ | 0.83 | 10.5 |
| J | $Fe_{36.7}Ni_{41.9}Mo_{4.0}B_{16.6}Si_{0.8}$ | 0.82 | 10.4 |
| K | $Fe_{35.6}Ni_{42.6}Mo_{4.0}B_{17.9}$ | 0.81 | 10 |
| L | $Fe_{34.7}Ni_{43.5}Mo_{4.0}B_{17.8}$ | 0.75 | 8.7 |
| M | $Fe_{33.3}Ni_{43.8}Mo_{3.9}Co_{0.2}Cr_{0.1}B_{17.7}Si_{1.0}$ | 0.71 | 7.8 |
| N | $Fe_{32.5}Ni_{44.7}Mo_{3.7}Co_{0.1}Cr_{0.2}B_{18.0}Si_{0.8}$ | 0.67 | 7.0 |

Table IV shows the magnetomechanical resonance characteristics of marker strips having different chemical compositions listed in Table III of an embodiment of the present invention with strip height h as defined in FIG. 1A. The definitions for $V_{0\ max}$, $H_{b0}$, $V_{1\ max}$ and $df_r dH_b$ were the same as in Table I. The length l of the strips were all about 38 mm. A radius of curvature for each marker strip was calculated from h and l. The resonance frequency of each strip was about 58 kHz.

TABLE IV

Magnetomechanical Resonance Characteristics of the Alloys in Table III

| Alloy No. | $V_{0max}$ (mV) | $H_{b0}$ (A/m) | $V_{1max}$ (mV) | $H_{b1}$ (A/m) | $df_r/dH_b$ [Hz/(A/m)] | Radius of Curvature (cm) |
|---|---|---|---|---|---|---|
| A | 188 | 471 | 70 | 368 | 13.0 | 33 |
| B | 174 | 490 | 89 | 348 | 10.4 | 36 |
| C | 160 | 320 | 72 | 300 | 8.80 | 25 |
| D | 158 | 580 | 83 | 580 | 4.85 | 33 |
| E | 180 | 441 | 106 | 370 | 9.29 | 50 |
| F | 184 | 370 | 94 | 330 | 8.10 | 71 |
| G | 171 | 472 | 85 | 351 | 9.73 | 27 |
| H | 146 | 352 | 60 | 250 | 13.4 | 30 |
| I | 160 | 341 | 84 | 329 | 7.06 | 34 |
| J | 160 | 410 | 85 | 340 | 8.92 | 51 |
| K | 154 | 420 | 94 | 389 | 8.51 | 36 |
| L | 166 | 369 | 97 | 309 | 8.77 | 28 |
| M | 182 | 331 | 106 | 280 | 10.1 | 38 |
| N | 128 | 269 | 79 | 250 | 5.58 | 116 |

All of the chemistries examined yielded magnetomechanical resonance signal such as $V_1$ close to, or greater than, corresponding values for conventional marker strips listed in Table 1. Thus, depending on the requirement of an electronic article surveillance system, a most appropriate chemical composition may be selected from the above list.

Figure 4:
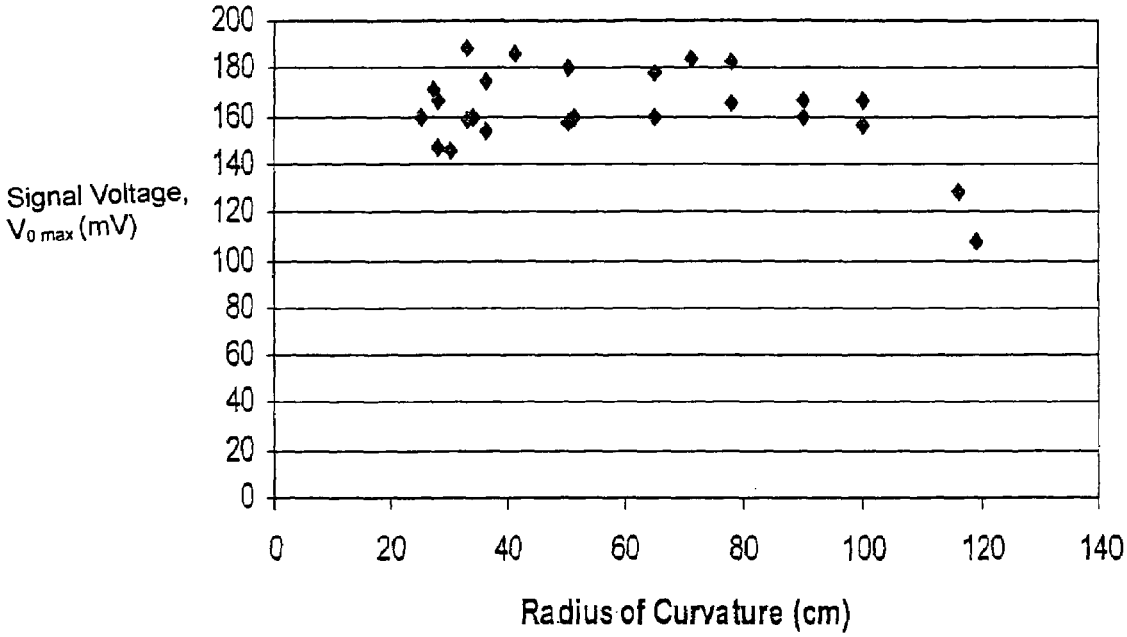
FIG. 4 illustrates signal voltage plotted against radius of curvature of a marker strip of an embodiment of the present invention.

To obtain a selected range for the radius of curvature of a marker strip in accordance with embodiments of the invention, signal voltage $V_{0\ max}$ is plotted in FIG. 4 against marker strip's radius of curvature using the data given in Tables I and IV. A signal voltage $V_{0\ max}$ exceeding 100 mV is acceptable for a reliable marker performance and therefore any marker strip with a radius of curvature less than 120 cm is suited for a marker strip of the present invention. However, a higher $V_{0\ max}$ value is selected in accordance with embodiments of the invention. As FIG. 4 indicates, high $V_{0\ max}$ values exceeding 140 mV were achieved in the radius-of-curvature range below about 100 cm. Thus, a marker strip with a radius of curvature less than about 100 cm is selected in accordance with embodiments of the invention. Another limiting factor for the strip's curvature arises from industry's accepted marker tag height which is about 1.6 mm. This marker height must accommodate the marker strip height h indicated in FIG. 1A and the thickness of a bias magnet 12 in addition to the thickness of tag's outer casing, resulting in a maximum marker strip height h to about 0.9 mm which corresponds to a radius-of-curvature of about 20 cm for the marker strip. Thus, the overall selected radius-of-curvature for a marker strip of the present invention is between 20 cm and 100 cm for embodiments of the invention.

Figure 5:
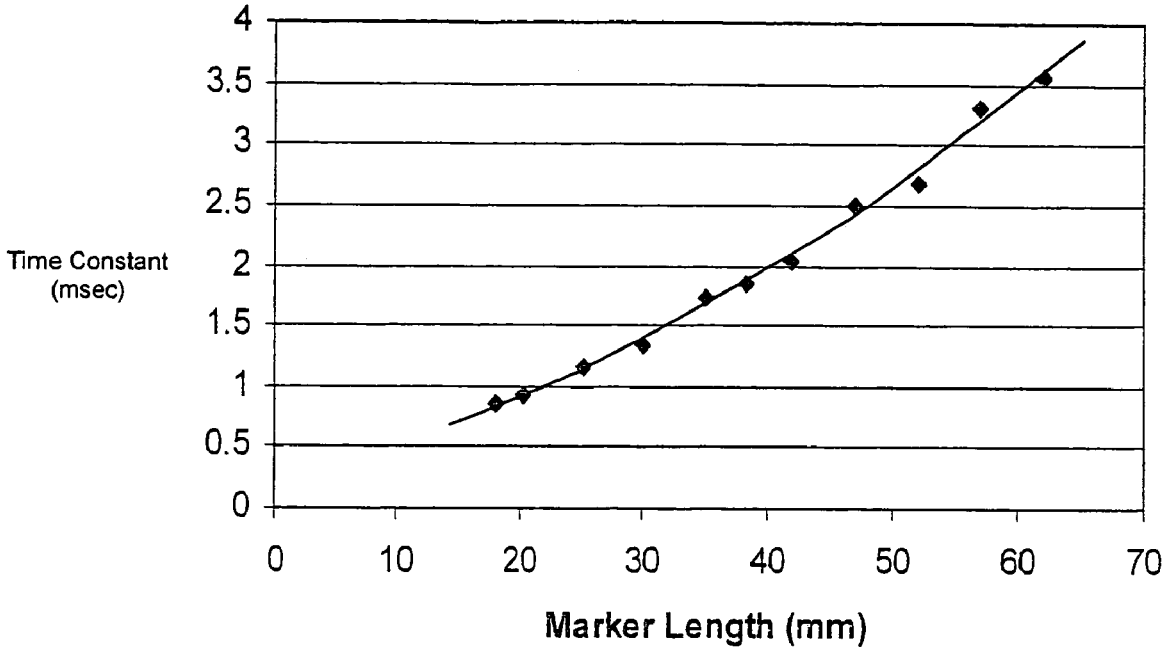
FIG. 5 illustrates a characteristic time constant for magnetomechanical resonance signal decay as a function of the length of a marker strip of an embodiment of the present invention.

Furthermore, ribbons slit to about a 6 mm wide width, in accordance with Example 1, were cut into strips with different lengths, and their magnetomechanical resonance properties were examined. In addition to the properties covered in Tables I, II and IV above, a complementary test to determine the effectiveness of a magnetomechanical resonance strip was performed using the following formula:

$$V(t)=Vo\ \exp(-t/\tau), \quad (2)$$

wherein t is the time measured after termination of an AC field excitation and $\tau$ is a characteristic time constant for the resonance signal decay. The values of $V_{1\ max}$ in Tables I, II and IV were determined from the data for t=1 msec. The results are given in Table V, in which other parameters characterizing the resonance properties of differing strip lengths are summarized. It is noted that $f_r$ follows the relationship of Equation (1) quite well, giving a relationship of $f_r$=2.1906×106/l Hz, where l is the length of a marker strip in mm. Also noted is the increase of $\tau$ with increasing strip length, as shown in FIG. 5. FIG. 5 indicates that the characteristic time constant $\tau$ increases from about 0.7 msec for a marker length l of about 15 mm to about 3.9 msec for l of about 65 mm. A larger value of $\tau$ is selected when a longer signal retention is desired in embodiments of the invention. Thus, marker strips of the present invention listed in Table V provides opportunities for a wide variety of electronic article surveillance systems utilizing different resonance frequencies.

As shown in Table V, magnetomechanical resonance characteristics of marker strips of an embodiment of the present invention with different lengths, l, were measured by using Alloy K in Table III. The width and thickness of each strip were about 6 mm and about 28 μm, respectively. The definitions of $V_{0\ max}$, $H_{b0}$, $V_{1max}$, $H_{b1}$ and $df_r/dH_b$ were the same as in Table I. The time constant was defined in Equation (2). Marker height h was defined in FIG. 1A, and the radius of curvature of each strip was calculated using h and l.

TABLE V

| Strip Length (mm) | Resonance Frequency (Hz) | $V_{0max}$ (mV) | $H_{b0}$ (A/m) | Time Constant $\tau$ (msec) | $V_{1max}$ (mV) | $H_{b1}$ (A/m) | $df_r/dH_b$ [Hz/(A/m)] | Radius of Curvature (cm) |
|---|---|---|---|---|---|---|---|---|
| 18.01 | 120772 | 73 | 610 | 0.85 | 23 | 520 | 6.65 | 26 |
| 20.16 | 108536 | 68 | 550 | 0.92 | 25 | 370 | 8.07 | 22 |
| 24.99 | 87406 | 94 | 460 | 1.16 | 42 | 338 | 6.55 | 22 |
| 30.02 | 72284 | 135 | 461 | 1.35 | 69 | 342 | 9.44 | 36 |
| 35.03 | 61818 | 143 | 387 | 1.74 | 79 | 322 | 8.73 | 29 |
| 37.95 | 56782 | 160 | 389 | 1.86 | 91 | 337 | 7.89 | 31 |
| 41.90 | 51336 | 184 | 389 | 2.03 | 109 | 350 | 6.67 | 43 |
| 46.95 | 45992 | 178 | 330 | 2.49 | 116 | 320 | 5.21 | 45 |
| 52.12 | 41438 | 197 | 331 | 2.69 | 132 | 312 | 5.28 | 35 |
| 56.99 | 37900 | 187 | 292 | 3.30 | 135 | 291 | 5.93 | 37 |
| 62.07 | 34864 | 197 | 293 | 3.56 | 148 | 279 | 4.94 | 34 |

Figure 6:
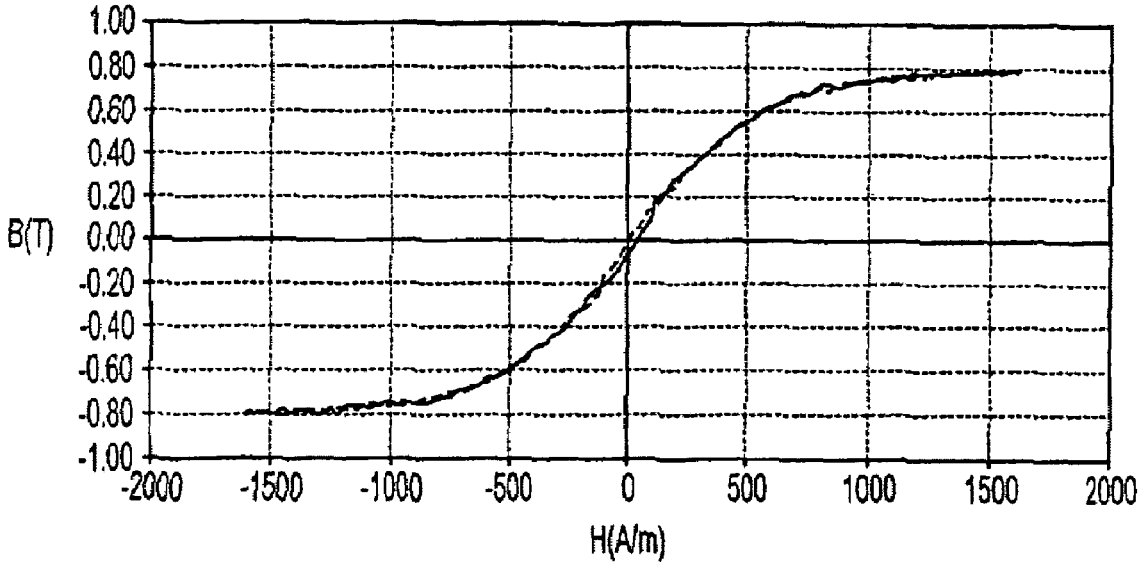
FIG. 6 illustrates a BH loop taken at 60 Hz on a marker strip of an embodiment of the present invention having a length of approximately 38 mm, a width of approximately 6 mm and a thickness of about 28 μm.

In addition to the basic magnetic properties, such as saturation magnetic induction and magnetostriction, listed in Table III, that are required to generate magnetomechanical resonance in a marker strip of an embodiment of the present invention, the direction of magnetic anisotropy, which is the direction of easy magnetization in a marker strip, must be essentially perpendicular to the strip's length direction. This is indeed the case, as indicated in FIG. 6, which depicts a BH loop taken at 60 Hz using a measurement method of Example 3 on an approximately 38 mm long strip from Table V above. The BH loop of FIG. 6 indicates that the remanent magnetic induction at H=0, i.e., B(H=0), is close to zero and the permeability defined by B/H near H=0 is linear. The shape of the BH loop shown in FIG. 6 is typical or characteristic of the BH behavior of a magnetic strip in which the average direction of the magnetic anisotropy is perpendicular to strip's length direction. A consequence of the magnetization behavior of a marker strip of an embodiment of the present invention shown in FIG. 6 is the absence of higher harmonics generation in the strip when the strip is placed in an AC magnetic field. Thus, the system "pollution problem" as mentioned in the "Background of the Invention" section, is minimized. To further check this point, a higher harmonic signal from the marker strip of FIG. 6 was compared with that of a marker strip of an electronic article surveillance system based on magnetic harmonic generation/detection. The results of this comparison are given in Table VI below.

As shown in Table VI, a magnetic higher harmonics signal comparison was made between a marker strip of an embodiment of the present invention and a marker strip based on Co-based METGLAS®2714A alloy, which is widely used in an electronic article surveillance system based on a magnetic harmonic generation/detection system. The strip size was the same for both cases and was approximately 38 mm long and approximately 6 mm wide. The fundamental excitation frequency was 2.4 kHz and the $25^{th}$ harmonic signals were compared by using a harmonic signal detection method of Example 4.

TABLE VI

| Marker Type | $25^{th}$ Harmonic Signal (mV) |
|---|---|
| Present Invention | 4 |
| Harmonic Marker | 40 |

As Table VI indicates, a negligibly small harmonic signal from a marker of an embodiment of the present invention does not trigger an electronic article surveillance system based on magnetic harmonic generation/detection.

Figure 7A:
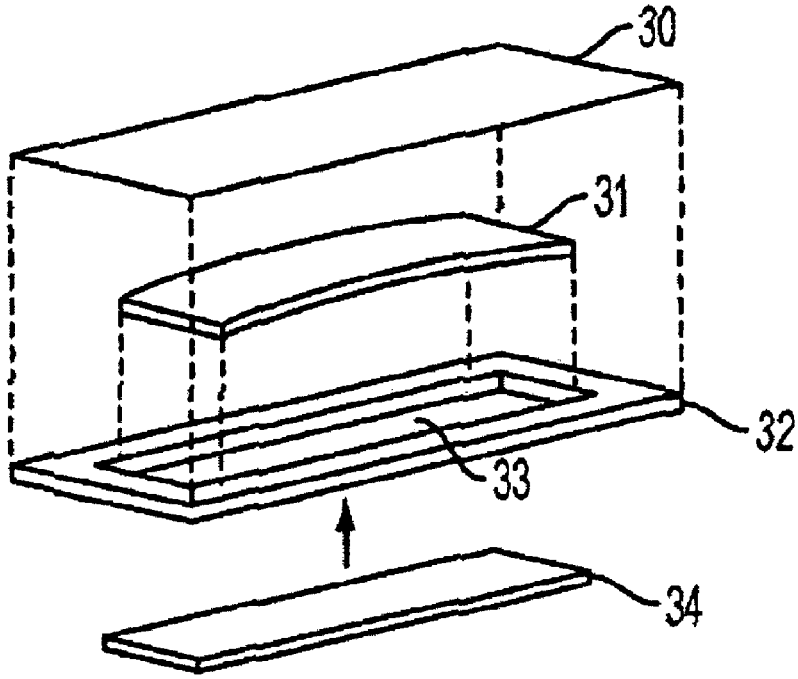
FIG. 7A illustrates a magnetomechanical resonant marker of an embodiment of the present invention with one marker strip of FIG. 1A.
Figure 7B:
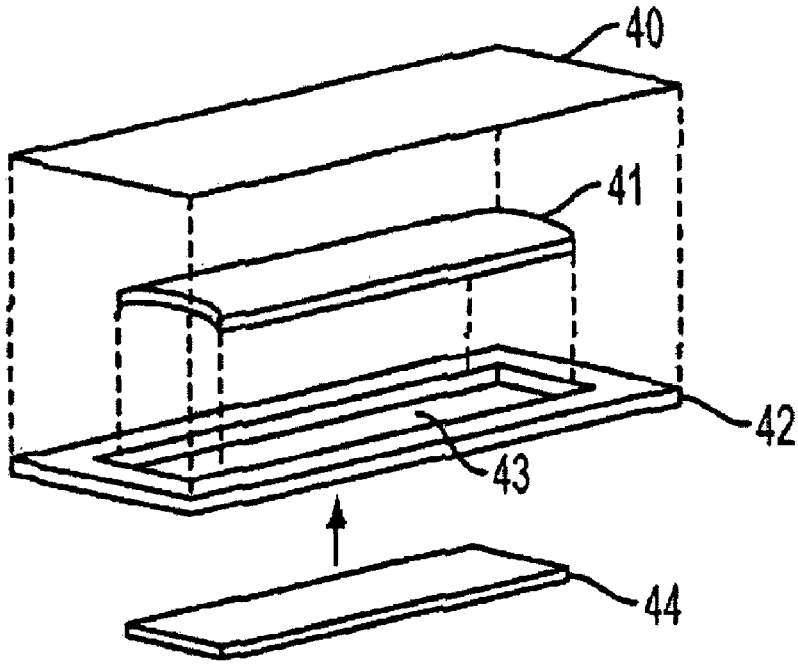
FIG. 7B CONVENTIONAL ART
FIG. 7B illustrates a conventional marker with the strip of FIG. 1B.

FIG. 7A illustrates a physical configuration of a magnetomechanical resonance marker of the present invention where a single marker strip in accordance with an embodiment of the present invention is utilized. The marker strip is any one of the strips listed in Table I, II, IV and V. In this figure, a marker strip 31 of the present invention is placed in a hollow area 33 in which the marker 31 is free to vibrate without physical constraints with non-magnetic casing materials 30 and 32 enclosing the marker strip 31. A bias magnet 34 is attached on the outside surface of casing 32 as an arrow indicates. In this configuration, the basic magnetic interaction between a marker strip 31 and a bias magnet 34 is the same as depicted in FIG. 1A. As a comparison, a conventional marker configuration is shown in FIG. 7B, in which a prior art marker strip 41 is encased a cavity area 43 between item 40 and 42, with a bias magnet 44 attached on the outside surface of casing 42.

Figures 1, 8A:
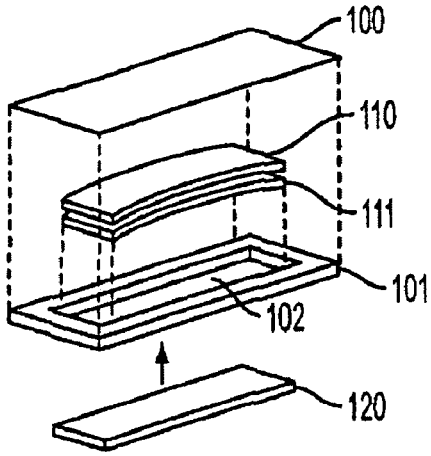
Figures 2, 8A:
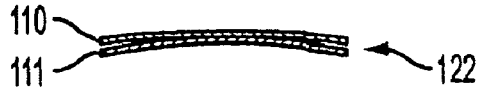
Figures 1, 8B:
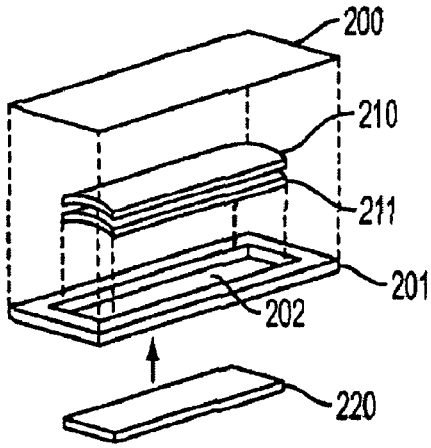
FIG. 8B-1 CONVENTIONAL ART
Figures 2, 8B:
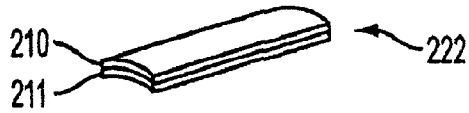
FIG. 8B-2 CONVENTIONAL ART

Two marker-strips for embodiments of the present invention were selected randomly from a number of strips characterized in Table I, II, and V with the same dimension, but with slightly different curvatures or two strips having the same chemical composition with the same dimension and with slightly different curvatures are mounted on top of each other, and a marker was made as in FIG. 8A-1, wherein strips 110 and 111 were marker strips of an embodiment of the present invention being housed in a cavity region 102 created between outside casing material 100 and 101, and a bias magnet 120 was attached on the outside surface of a casing material 101 as indicated by an arrow in the figure. FIG. 8A-2 illustrates a side view of the two maker-strips of an embodiment of the present invention, showing the two strips with slightly different curvatures touching along one line across the strip's width direction. For comparison, a marker configuration for two conventional marker-strips is shown in FIG. 8B-1, wherein conventional marker strips 210 and 211 are placed in a cavity region 202 between outer casings 200 and 201, and a bias magnet 220 is attached to the outside surface of casing 201, as indicated by an arrow in the figure. FIG. 8B-2 illustrates a view of the two conventional strips from an angle, showing the two strips touching face-to-face because the strip's curvature along their width direction is the same due to the specific annealing method used in preparing the conventional marker-strips, as described in the '702 patent.

Figure 9:
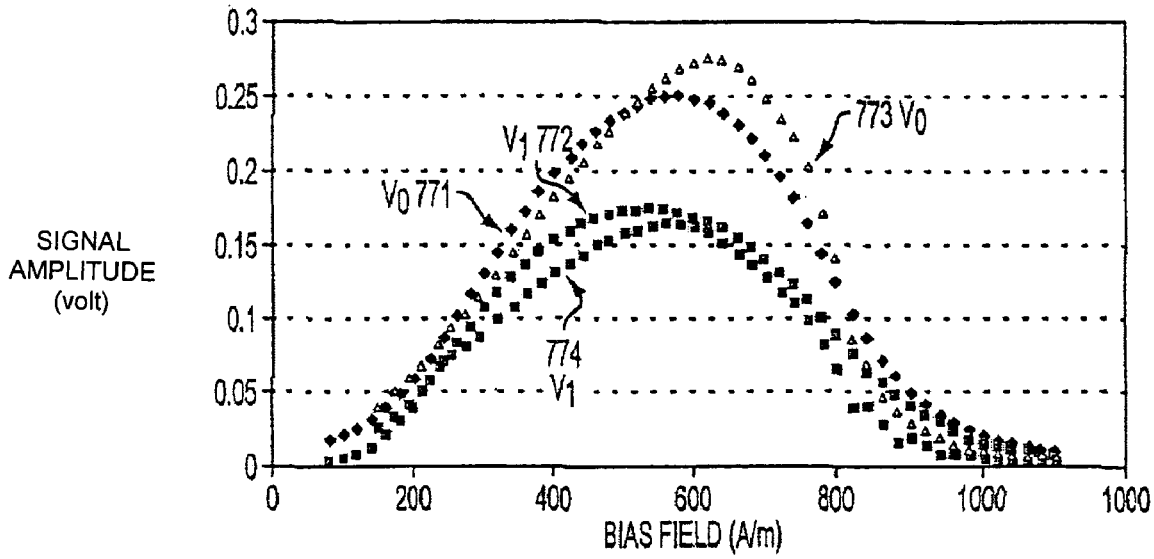
FIG. 9 illustrates magnetomechanical resonance characteristics of a two-strip marker of an embodiment of the present invention and a two-strip conventional marker, showing resonance signals as a function of bias field.

The magnetomechanical resonance behavior, using $V_0$771 and $V_1$772, of this two-strip marker of an embodiment of the present invention is compared in FIG. 9 with the magnetomechanical resonance behavior, using $V_0$773 and $V_1$774, of a conventional two-strip marker. A further comparison of the resonance characteristics between two-strip markers of an embodiment of the present invention and representative conventional two-strip markers is summarized in Table VII, in which strips Nos. 12-19 were made from an amorphous alloy ribbon of an embodiment of the present invention. The peak signal amplitude $V_{1\ max}$ at $H_{b1}$ and the resonance frequency slope of the marker of an embodiment of the present invention are about the same as, or slightly greater than, that of a conventional two-strip marker. Table VII also indicates that the frequency-bias slope, $df_r/dH_b$, may be adjusted to a selected magnitude for embodiments of the invention depending on the requirement of a surveillance system. The advantage of two-strip marker configuration of an embodiment of the present invention over that of a conventional two-strip marker is further demonstrated in Table VIII, in which an average signal amplitude $<V_{0\ max}>$ of each individual marker and that of a two strip marker, $V_{0\ max}$, using the two marker-strips are compared. It is noted that the ratio $V_{0\ max}/<V_{0\ max}>$ for two-strip markers of an embodiment of the present invention is centered around 1.65 with a very small variation from marker to marker, whereas the same ratio varies widely from 1.4 to 1.9 for conventional two-strip markers. The reason for the improved performance of a two-strip marker of an embodiment of the present invention is given as follows: As depicted in FIG. 8A-2, each of the two marker strips of an embodiment of the present invention has a curvature along the strip length direction and touch on one line in the center generally as indicated in numeral 122, whereas the two resonator strips of prior art touch at many points in the strip's surfaces between the two strips as indicated in numeral 222 in FIG. 8B-2, introducing more damping in mechanical vibration in the latter than the former.

As shown in Table VII, resonance characteristics were measured of two-strip markers of an embodiment of the present invention with a length of about 38 mm, a width of about 6 mm and a thickness of about 28 μm. The values for conventional markers with five samples had ranges as shown. The resonance frequency of each marker was about 58 kHz. The definitions of $V_{0\ max}$, $H_{b0}$, $V_{1\ max}$, $H_{b1}$ and $df_r/dH_b$ were the same as in Table 1.

TABLE VII

| Marker | $V_{0max}$ (mV) | $H_{b0}$ (A/m) | $V_{1max}$ (mV) | $H_{b1}$ (A/m) | $df_r/dH_b$ [Hz/(A/m)] |
|---|---|---|---|---|---|
| Conventional | 266~306 | 590~620 | 157~190 | 499~569 | 7.16~8.24 |
| Present Invention No. 12 | 257 | 680 | 153 | 500 | 6.84 |
| No. 13 | 269 | 692 | 153 | 529 | 8.96 |
| No. 14 | 279 | 645 | 173 | 535 | 9.78 |
| No. 15 | 280 | 689 | 152 | 559 | 9.93 |
| No. 16 | 250 | 558 | 174 | 538 | 4.44 |
| No. 17 | 238 | 541 | 150 | 521 | 4.44 |
| No. 18 | 251 | 540 | 160 | 520 | 4.53 |
| No. 19 | 241 | 560 | 161 | 540 | 3.66 |

As shown in Table VIII, effects of marker strip shape on the magnetomechanical performance of a two-strip marker in accordance with an embodiment of the present invention and that of conventional two-strip marker were examined. The resonance frequency of each marker was about 58 kHz.

TABLE VIII

Characteristics of two-strip markers of the present invention.

| | $V_{0max}$ (mV) | Average $V_{0max}$ of individual marker strip $<V_{0max}>$ (mV) | Ratio $V_{0max}/<V_{0max}>$ |
|---|---|---|---|
| Double Strip Marker of an Embodiment of Present Invention | | | |
| No. 20 | 257 | 152 | 1.65 |
| No. 21 | 249 | 151 | 1.65 |
| No. 22 | 269 | 162 | 1.67 |
| No. 23 | 279 | 167 | 1.68 |
| No. 24 | 280 | 170 | 1.65 |
| Conventional | | | |
| A | 266 | 167 | 1.61 |
| B | 275 | 195 | 1.41 |
| C | 293 | 187 | 1.57 |
| D | 306 | 158 | 1.94 |
| E | 293 | 183 | 1.61 |

Figure 10:
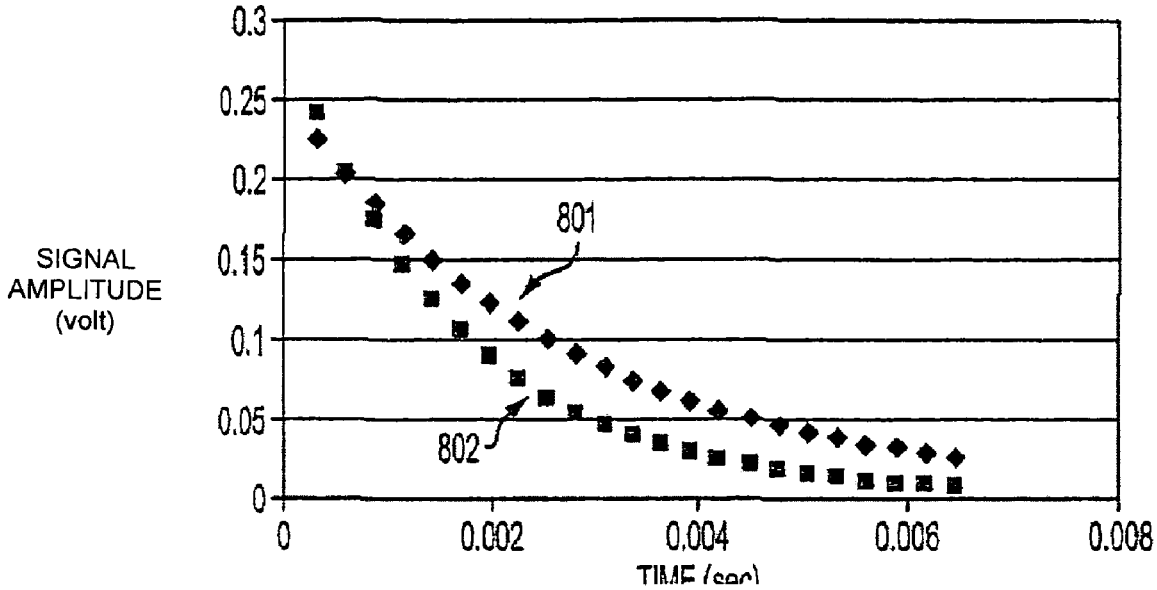
FIG. 10 illustrates magnetomechanical resonance signal decay of a two-strip marker of an embodiment of the present invention and a two-strip conventional marker, showing resonance response signal as a function of time after termination of excitation.

The aspect of reduced mechanical damping in a two-strip marker of an embodiment of the present invention was examined and is demonstrated in FIG. 10, where resonance signal amplitude is plotted against time after the termination of an alternating field which initiates the magnetomechanical resonance for a two-strip marker 801 of an embodiment of the present invention and for a conventional two-strip marker 802. It is clear that the resonance phenomenon persists much longer in a two-strip marker of an embodiment of the present invention than a conventional two-strip marker because the two marker-strips of the embodiment of the present invention touch only on one line across the strip's width direction, whereas the two conventional marker-strips touch face-to-face with each other. The data given in FIG. 10 was further analyzed by using Equation (2) given above. Table IX compares values of $\tau$ thus obtained for two-strip markers of an embodiment of the present invention and conventional markers.

As shown in Table IX, time constants $\tau$ are listed for resonance signal decay for two-strip markers, samples No. 25 through No. 30, of an embodiment of the present invention and for conventional samples A through E, which are the same as those found in Table VIII. The signal decay data were fitted to Equation (2) above with the parameters $V_{0\ max}$ and $\tau$ given below. The resonance frequency of each marker was about 58 kHz. The longer time constants for the two-marker strips of the present invention indicate that signal decay over time is considerably smaller than that of a conventional two-strip marker. Thus, a marker based on two strips from an embodiment of the present invention is superior to that from a prior art material.

TABLE IX

| | $V_{0max}$ (mV) | $\tau$ (msec) |
|---|---|---|
| Two-Strip Marker of an Embodiment of the Present Invention | | |
| No. 25 | 204 | 2.58 |
| No. 26 | 201 | 2.62 |
| No. 27 | 251 | 2.80 |
| No. 28 | 238 | 2.12 |
| No. 29 | 251 | 2.10 |
| No. 30 | 248 | 2.43 |
| Conventional | | |
| A | 266 | 1.69 |
| B | 275 | 1.75 |
| C | 293 | 1.95 |
| D | 306 | 1.38 |
| E | 293 | 2.23 |

The advantages of having multiple marker-strips are further provided by an example of a three-strip marker. For this purpose, three randomly selected strips with the same length and width of an embodiment of the present invention were mounted on top of each other, and a three-strip marker was formed and tested.

Figure 11:
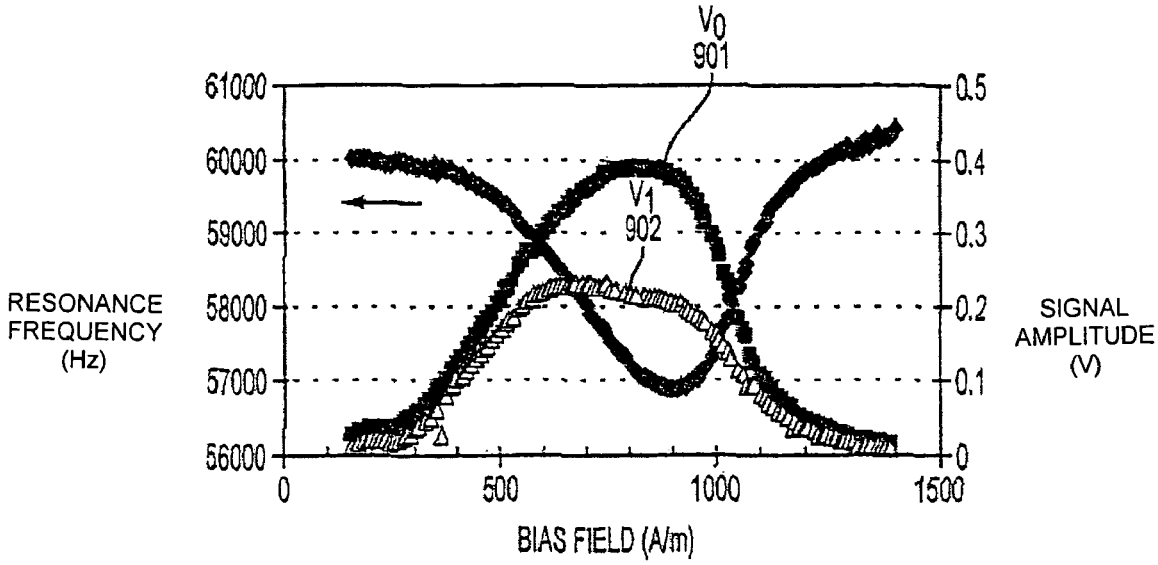
FIG. 11 illustrates magnetomechanical resonance characteristics of a three-strip marker of an embodiment of the present invention, showing resonance frequency and response signals as a function of bias field.

As shown in FIG. 11, the magnetomechanical performance was further improved in a three-strip marker with a higher signal amplitude, $V_0$901 and $V_1$902, than that shown in FIG. 9, obtained for a two-strip marker. Again consistency of the magnetomechanical performance from marker to marker is demonstrated in Table X in terms of small variability of the ratio $V_{0max}/\langle V_{0max}\rangle$. This performance consistency arises from reduced mechanical damping of the constituent strips in a marker of an embodiment of the present invention as observed consistently in a marker having two strips of an embodiment of the present invention; see Table VIII. The performance consistency is further provided by small variations of $V_{0max}$, $H_{b0}$, $V_{1max}$, $H_{b1}$ and bias slope, $df_r/dH_b$ [Hz/(A/m)] among different markers, as seen in Table X.

As shown in Table X, resonance characteristics of a three-strip marker of an embodiment of the present invention were examined. The definitions of the basic quantities are the same as in Table I. The resonance frequency of each three-strip maker was about 58 kHz.

TABLE X

| Three-Strip Marker | $V_{0max}$ (mV) | $H_{b0}$ (A/m) | $V_{1max}$ (mV) | $H_{b1}$ (A/m) | $df_r/dH_b$ [Hz/(A/m)] | Average $V_{0max}$ of Three Strips $\langle V_{0max}\rangle$ (mV) | Ratio of $V_{0max}/\langle V_{0max}\rangle$ |
|---|---|---|---|---|---|---|---|
| No. 31 | 351 | 842 | 152 | 600 | 5.07 | 152 | 2.31 |
| No. 32 | 361 | 818 | 143 | 689 | 8.03 | 165 | 2.19 |
| No. 33 | 359 | 839 | 152 | 641 | 6.44 | 171 | 2.10 |
| No. 34 | 390 | 833 | 160 | 627 | 7.02 | 177 | 2.20 |
| No. 35 | 332 | 800 | 203 | 691 | 6.08 | 158 | 2.10 |

A further aspect of the present invention is to provide an electronic article surveillance marker with enhanced detection capability. Thus markers with four and five marker strips were examined, and the results are summarized in Table XI.

As shown in Table XI, magnetomechanical resonance characteristics of markers with four and five marker strips of embodiments of the present invention were determined. The definitions of $V_{0max}$, $H_{b0}$, $V_{1max}$, $H_{b1}$ and $df_r/dH_b$ were the same as in Table I. The resonance frequency of each marker was about 58 kHz.

TABLE XI

| Number of Marker Strip | $V_{0max}$ (mV) | $H_{b0}$ (A/m) | $V_{1max}$ (mV) | $H_{b1}$ (A/m) | $df_r/dH_b$ [Hz/(A/m)] |
|---|---|---|---|---|---|
| 4 | 341 | 800 | 257 | 800 | 2.37 |
| 5 | 368 | 887 | 280 | 887 | 3.14 |

Figure 12:
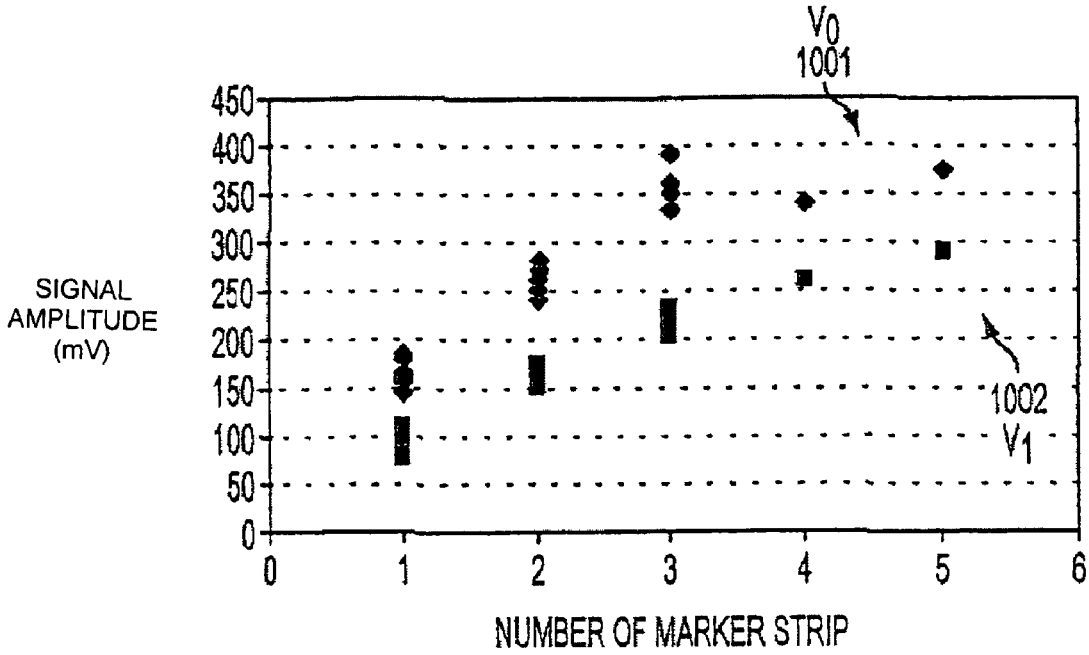
FIG. 12 illustrates resonance signal amplitudes, $V_{0max}$ and $V_{1max}$, as a function of the number of marker strips.

The values of $V_{0\,max}$1001 and $V_{1\,max}$1002 from Tables I, IV, VII, X and XI are plotted against a number of marker strips in FIG. 12. A rapid increase of the magnetomechanical resonance signals is observed for up to three marker strips, beyond which the rate of signal increase with the strip number is gradual, but still showing the advantageous effect of increased number of marker strips for enhanced resonance signal detection.

Figure 13:
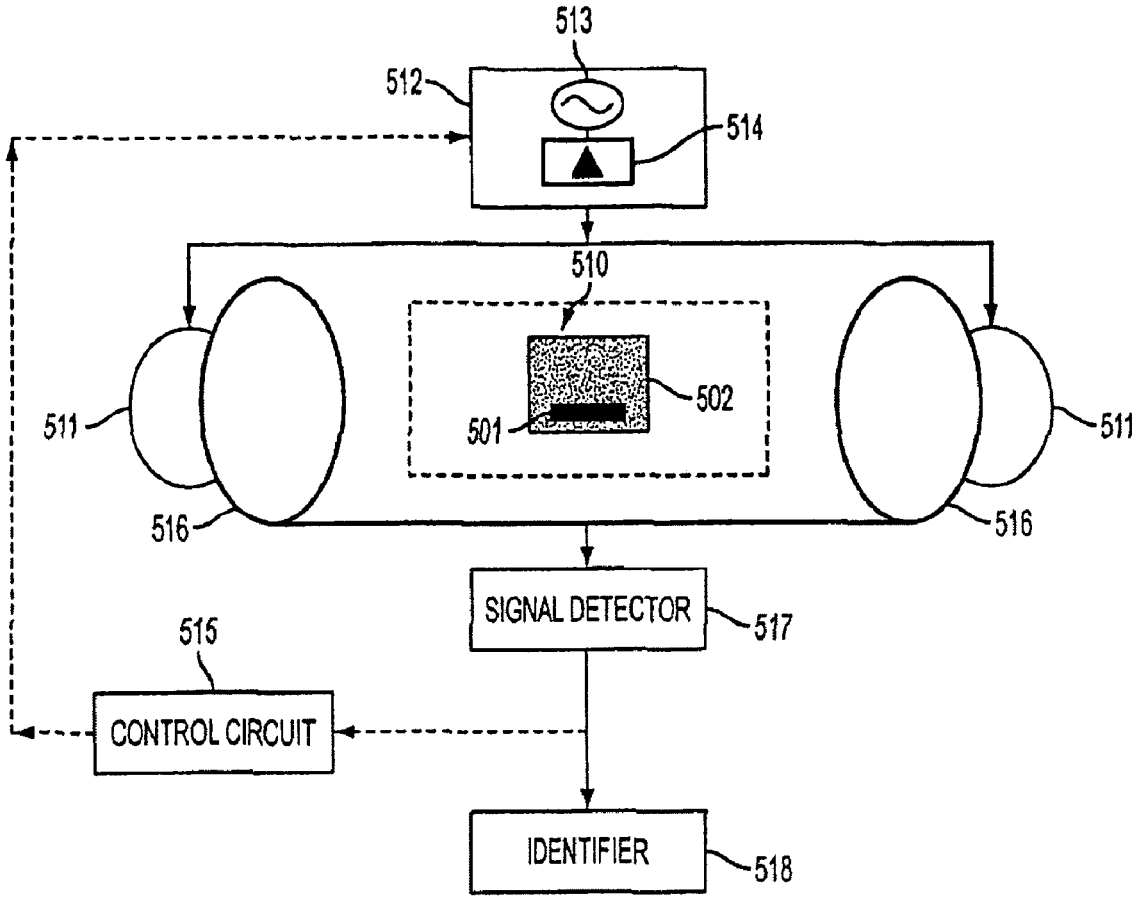
FIG. 13 is a schematic illustration of an electronic article surveillance system of an embodiment of the present invention.

A marker with one rectangular amorphous magnetostrictive alloy strip or a plurality of rectangular amorphous magnetostrictive alloy strips prepared in accordance with the present invention, such as the one exemplified in FIG. 7A and FIG. 8A-1, respectively is utilized in an electronic article surveillance system illustrated in FIG. 13. As shown, an article 502 having a marker 501 of an embodiment of the present invention is placed in an interrogation zone 510 equipped with a pair of AC field excitation coils 511, which is driven by an electronic device 512 consisting of a signal generator 513 and an AC amplifier 514. The electronic device 512 is programmed to excite marker strips of the embodiment of the present invention up to a predetermined time period, at which time the excitation is terminated. After the termination of the excitation in coils 511, a signal detected in the signal receiving coils 516 is fed to a signal detection circuit box 517, which is tuned to a resonance frequency of the marker in the interrogation zone 510. The excitation field termination and the onset of signal detection are controlled by a circuit box 515. The signal detector 517 is connected to an identifier 518, which conveys a result of the interrogation to an interrogator. When article 502 with an electronic surveillance marker of an embodiment of the present invention 501 exits the interrogation zone 510, the marker is deactivated by a demagnetizing field, if desired.

EXAMPLE 1

A slit ribbon was cut into ductile and rectangular strips with a conventional metal ribbon cutter. The curvature of each strip was determined optically by measuring the height, h, of the curved surface over the strip length, l, as defined in FIG. 1A.

EXAMPLE 2

The magnetomechanical performance was determined in a set-up in which a pair of coils supplying a static bias field and the voltage appearing in a signal detecting coil compensated by a bucking coil was measured by an oscilloscope and a voltmeter. The measured voltage therefore is detecting-coil dependent and indicates a relative signal amplitude. The exciting AC field was supplied by a commercially available function generator. The function generator was programmed to excite a marker strip or strips of the present invention for 3 msec, after which period the excitation was terminated, and the signal decay was measured with time. The data thus taken were processed and analyzed with a commercially available computer software.

EXAMPLE 3

A commercially available DC BH loop measurement equipment was utilized to measure magnetic induction B as a function of applied field H. For an AC BH loop measurement, an exciting coil-detecting coil assembly similar to that of Example 4 was used, and output signal from the detecting coil was fed into an electronic integrator. The integrated signal was then calibrated to give the value of the magnetic induction B of a sample. The resultant B was plotted against applied field H, resulting in an AC BH loop. In both AC and DC cases, the direction of the applied field and the measurement was along marker strips' length direction.

EXAMPLE 4

A marker strip prepared in accordance with Example 1 was placed in an exciting AC field at a predetermined fundamental frequency, and its higher harmonics response was detected by a coil containing the strip. The exciting coil and signal detecting coil were wound on a bobbin with a diameter of about 50 mm. The number of the windings in the exciting coil and the signal detecting coil was about 180 and about 250, respectively. The fundamental frequency was chosen at 2.4 kHz and its voltage at the exciting coil was about 80 mV. The $25^{th}$ harmonic voltages from the signal detecting coil were measured.

In accordance with an embodiment of the invention, a marker of a magnetomechanical resonant electronic article surveillance system, comprises: at least one ductile magnetostrictive marker strip cut from an amorphous ferromagnetic alloy ribbon that has a curvature along a ribbon length direction and exhibits magnetomechanical resonance under alternating magnetic field excitation with a static bias field, the said at least one marker strip having a magnetic anisotropy direction along a direction perpendicular to a ribbon axis.

Where selected, a radius of curvature of the at least one ductile magnetostrictive marker strip is less than 120 cm. A selected range for the radius of curvature of a marker strip is between about 20 cm and about 100 cm for embodiments of the invention.

In accordance with an embodiment of the invention, the amorphous ferromagnetic alloy ribbon has a saturation induction ranging from about 0.6 tesla to about 1.1 tesla.

In accordance with an embodiment of the invention, the amorphous ferromagnetic alloy ribbon has a saturation magnetostriction ranging from about 6 ppm to about 18 ppm.

In accordance with an embodiment of the invention, the amorphous ferromagnetic alloy ribbon has a composition based on $Fe_a$—$Ni_b$—$Mo_c$—$B_d$ with $30 \leqq a \leqq 43$, $35 \leqq b \leqq 48$, $0 \leqq c \leqq 5$, $14 \leqq d \leqq 20$ and $a+b+c+d=100$, up to 3 atom % of Mo being optionally replaced by Co, Cr, Mn and/or Nb and up to 1.5 atom % of B being optionally replaced by Si and/or C.

In accordance with an embodiment of the invention, the amorphous ferromagnetic alloy ribbon is an alloy having a composition of one of $Fe_{41.7}Ni_{39.4}Mo_{3.1}B_{15.8}$, $Fe_{41.5}Ni_{38.9}Mo_{4.1}B_{15.5}$, $Fe_{39.8}Ni_{39.2}Mo_{3.1}B_{17.6}C_{0.3}$, $Fe_{40.2}Ni_{39.0}Mo_{3.6}B_{16.6}Si_{0.6}$, $Fe_{36.5}Ni_{42.9}Mo_{4.2}B_{16.5}$, $Fe_{40.6}Ni_{41.9}Mo_{3.7}B_{15.1}Si_{0.5}$, $Fe_{39.6}Ni_{38.3}Mo_{4.1}B_{18.0}$, $Fe_{38.0}Ni_{38.8}Mo_{3.9}B_{19.3}$, $Fe_{36.9}Ni_{41.3}Mo_{4.1}B_{17.8}$, $Fe_{36.7}Ni_{41.9}Mo_{4.0}B_{16.6}Si_{0.8}$, $Fe_{35.6}Ni_{42.6}Mo_{4.0}B_{17.9}$, $Fe_{34.7}Ni_{43.5}Mo_{4.0}B_{17.8}$, $Fe_{33.3}Ni_{43.8}Mo_{3.9}Co_{0.2}Cr_{0.1}B_{17.7}Si_{1.0}$, or $Fe_{32.5}Ni_{44.7}Mo_{3.7}Co_{0.1}Cr_{0.2}B_{18.0}Si_{0.8}$ In accordance with an embodiment of the invention, the at least one marker strip has a discrete length and exhibits magnetomechanical resonance at a length-related frequency.

Where selected, the at least one marker strip has a length ranging from about 15 to about 65 mm.

Where selected, the at least one marker strip has a marker strip width ranging from about 3 mm to about 15 mm.

In accordance with an embodiment of the invention, the at least one marker strip has a length-to-width ratio exceeding 3.

In accordance with an embodiment of the invention, the at least one marker strip has a characteristic time constant for magnetomechanical resonance signal decay ranging from about 0.7 msec to about 3.9 msec.

In accordance with an embodiment of the invention, the at least one marker strip has a characteristic BH loop with a near-zero remanent magnetic induction at zero-applied magnetic field.

In accordance with an embodiment of the invention, the at least one marker strip has a slope of resonance frequency versus bias field ranging from about 4 Hz/(A/m) to about 14 Hz/(A/m).

In accordance with an embodiment of the invention, the marker comprises a plurality of marker strips with different radius of curvatures along the marker strips' length direction and with the same length.

Where selected, the plurality of marker strips are stacked or placed side-by-side.

In accordance with an embodiment of the invention, the marker comprises two marker strips and has a slope of resonance frequency versus bias field ranging from about 3.5 Hz/(A/m) to about 10 Hz/(A/m).

In accordance with an embodiment of the invention, the marker comprises three marker strips and has a slope of resonance frequency versus bias field ranging from about 4 Hz/(A/m) to about 9 Hz/(A/m).

In accordance with an embodiment of the invention, the marker comprises four or five marker strips and has a slope of resonance frequency versus bias field ranging from about 2 Hz/(A/m) to about 4 Hz/(A/m).

Where selected, at least one bias magnet strip is placed along the at least one marker strip's direction.

In accordance with an embodiment of the invention, the at least one marker strip is housed in a cavity separated from the bias magnet strip.

In accordance with an embodiment of the invention, electronic article surveillance system has a capability of detecting resonance of a marker, and comprises a surveillance system tuned to predetermined surveillance magnetic field frequencies, wherein the surveillance system detects a marker that is adapted to mechanically resonate at a preselected frequency, and has at least one ductile magnetostrictive marker strip cut from an amorphous ferromagnetic alloy ribbon that has a curvature along a ribbon length direction and exhibits magnetomechanical resonance under alternating magnetic field excitation with a static bias field, the at least one marker strip having a magnetic anisotropy direction along a direction perpendicular to a ribbon axis.

Where selected, a radius of curvature of the at least one ductile magnetostrictive marker strip is between about 20 cm and about 100 cm for embodiments of the invention.

In accordance with an embodiment of the invention, the amorphous ferromagnetic alloy has a composition based on $Fe_a$—$Ni_b$—$Mo_c$—$B_d$ with $30 \leqq a \leqq 43$, $35 \leqq b \leqq 48$, $0 \leqq c \leqq 5$, $14 \leqq d \leqq 20$ and $a+b+c+d=100$, up to 3 atom % of Mo being optionally replaced by Co, Cr, Mn and/or Nb and up to 1.5 atom % of B being optionally replaced by Si and/or C.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A marker of a magnetomechanical resonant electronic article surveillance system, comprising at least one ductile magnetostrictive marker strip cut from an amorphous ferromagnetic alloy ribbon that has a curvature along a ribbon length direction and exhibits magnetomechanical resonance under alternating magnetic field excitation with a static bias field, the at least one marker strip having a magnetic anisotropy direction along a direction perpendicular to a ribbon axis, wherein a radius of curvature of the at least one ductile magnetostrictive marker strip is less than 120 cm.

2. The marker of claim 1, wherein a radius of curvature of the at least one ductile magnetostrictive marker strip has a range between 20 cm and 100 cm.

3. The marker of claim 1, wherein the at least one marker strip has a discrete length and exhibits magnetomechanical resonance at a length-related frequency.

4. The marker of claim 3, wherein the at least one marker strip has a length ranging from about 15 to about 65 mm.

5. The marker of claim 4, wherein the at least one marker strip has a marker strip width ranging from about 3 mm to about 15 mm.

6. The marker of claim 5, wherein the at least one marker strip has a length-to-width ratio exceeding 3.

7. The marker of claim 6, wherein the at least one marker strip has a characteristic time constant for magnetomechanical resonance signal decay ranging from about 0.7 msec to about 3.9 msec.

8. The marker of claim 1, wherein the at least one marker strip has a slope of resonance frequency versus bias field ranging from about 4 Hz/(A/m) to about 14 Hz/(A/m).

9. The marker of claim 1, wherein the marker comprises a plurality of marker strips with different radius of curvatures along the marker strips' length direction and with the same length.

10. The marker of claim 9, wherein at least two of the plurality of marker strips are stacked or placed side-by-side.

11. The marker of claim 10, wherein the marker comprises two marker strips and has a slope of resonance frequency versus bias field ranging from about 3.5 Hz/(A/m) to about 10 Hz/(A/m).

12. The marker of claim 9, wherein the marker comprises three marker strips and has a slope of resonance frequency versus bias field ranging from about 4 Hz/(A/m) to about 9 Hz/(A/m).

13. The marker of claim 9, wherein the marker comprises four or five marker strips and has a slope of resonance frequency versus bias field ranging from about 2 Hz/(A/m) to about 4 Hz/(A/m).

14. The marker of claim 1, further including at least one bias magnet strip placed along the at least one marker strip's direction.

15. The marker of claim 14, wherein the at least one marker strip is housed in in a cavity separated from the bias magnet strip.

16. A marker of a magnetomechanical resonant eletronic article surveillance system, comprising at least one ductile magnetostrictive marker strip cut from an amorphous ferromagnetic alloy ribbon that has a curvature along a ribbon length direction and exhibits magnetomechanical resonance under alternating magnetic field excitation with a static bias field, the at least one marker strip having a magnetic anisotropy direction along a direction perpendicular to a ribbon axis, wherein the amorphous ferromagnetic alloy ribbon has a saturation induction ranging from 0.6 tesla to 1.1 tesla.

17. The marker of claim 16, wherein the amorphous ferromagnetic alloy ribbon has a saturation magnetostriction ranging from 6 ppm to 18 ppm.

18. The marker of claim 16, wherein the amorphous ferromagnetic alloy ribbon has a composition based on $Fe_a$—$Ni_b$—$Mo_c$—$B_d$ with $30 \leqq a \leqq 43$, $35 \leqq b \leqq 48$, $0 \leqq c \leqq 5$, $14 \leqq d \leqq 20$ and $a+b+c+d=100$, up to 3 atom % of Mo being optionally replaced by Co, Cr, Mn and/or Nb and up to 1.5 atom % of B being optionally replaced by Si and/or C.

19. The marker of claim 18, wherein the amorphous ferromagnetic alloy ribbon is an alloy having a composition of one of $Fe_{41.7}Ni_{39.4}Mo_{3.1}B_{15.8}$, $Fe_{41.5}Ni_{38.9}Mo_{4.1}B_{15.5}$, $Fe_{39.8}Ni_{39.2}Mo_{3.1}B_{17.6}C_{0.3}$, $Fe_{40.2}Ni_{39.0}Mo_{3.6}B_{16.6}Si_{0.6}$, $Fe_{36.5}Ni_{42.9}Mo_{4.2}B_{16.5}$, $Fe_{40.6}Ni_{40.1}Mo_{3.7}B_{15.1}Si_{0.5}$, $Fe_{39.6}Ni_{38.3}Mo_{4.1}B_{18.0}$, $Fe_{38.0}Ni_{38.8}Mo_{3.9}B_{19.3}$, $Fe_{36.9}Ni_{41.3}Mo_{4.1}B_{17.8}$, $Fe_{36.7}Ni_{41.9}Mo_{4.0}B_{16.6}Si_{0.8}$, $Fe_{35.6}Ni_{42.6}Mo_{4.0}B_{17.9}$, $Fe_{34.7}Ni_{43.5}Mo_{4.0}B_{17.8}$, $Fe_{33.3}Ni_{43.8}Mo_{3.9}Co_{0.2}Cr_{0.1}B_{17.7}Si_{1.0}$, or $Fe_{32.5}Ni_{44.7}Mo_{3.7}Co_{0.1}Cr_{0.2}B_{18.0}Si_{0.8}$.

20. A marker of a magnetomechanical resonant electronic article surveillance system, comprising at least one ductile magnetostrictive marker strip cut from an amorphous ferromagnetic alloy ribbon that has a curvature along a ribbon length direction and exhibits magnetomechanical resonance under alternating magnetic field excitation with a static bias field, the at least one marker strip having a magnetic anisotropy direction along a direction perpendicular to a ribbon axis, wherein the amorphous ferromagnetic alloy ribbon has a characteristic BH loop with a near-zero remanent magnetic induction at zero-applied magnetic field.

21. An electronic article surveillance system having a capability of detecting resonance of a marker, comprising:

a surveillance system tuned to predetermined surveillance magnetic field frequencies, wherein the surveillance system detects a marker that is adapted to mechanically resonate at a preselected frequency, and has at least one ductile magnetostrictive marker strip cut from an amorphous ferromagnetic alloy ribbon that has a curvature along a ribbon length direction and exhibits magnetomechanical resonance under alternating magnetic field excitation with a static bias field, the at least one marker strip having a magnetic anisotropy direction along a direction perpendicular to a ribbon axis, and wherein a radius of curvature of the at least one ductile magnetostrictive marker strip is less than 120 cm.

* * * * *

UNITED STATES PATENT AND TRADEMARK OFFICE

CERTIFICATE OF CORRECTION

PATENT NO. : 7,561,043 B2
APPLICATION NO. : 11/607997
DATED : July 14, 2009
INVENTOR(S) : Ryusuke Hasegawa et al.

It is certified that error appears in the above-identified patent and that said Letters Patent is hereby corrected as shown below:

Column 21, Line 5, after "housed" delete "in".

Column 21, Line 7, change "eletronic" to --electronic--.

Signed and Sealed this

Third Day of November, 2009

David J. Kappos

David J. Kappos
*Director of the United States Patent and Trademark Office*